US010232640B2

(12) United States Patent
Merlet

(10) Patent No.: US 10,232,640 B2
(45) Date of Patent: Mar. 19, 2019

(54) METHOD FOR PROTECTING PRINTED DATA

(71) Applicant: EVOLIS, Beaucouze (FR)

(72) Inventor: Florent Merlet, Beaucouze (FR)

(73) Assignee: EVOLIS, Beaucouze (FR)

( * ) Notice: Subject to any disclaimer, the term of this patent is extended or adjusted under 35 U.S.C. 154(b) by 0 days.

(21) Appl. No.: 15/807,706

(22) Filed: Nov. 9, 2017

(65) Prior Publication Data

US 2018/0134050 A1 May 17, 2018

(30) Foreign Application Priority Data

Nov. 15, 2016 (FR) ..... 16 61053

(51) Int. Cl.

| | |
|---|---|
| ***B41J 11/00*** | (2006.01) |
| ***B41J 2/32*** | (2006.01) |
| ***B41M 3/14*** | (2006.01) |
| ***B41M 5/382*** | (2006.01) |
| ***B41J 2/325*** | (2006.01) |
| ***B41J 13/12*** | (2006.01) |
| *B41M 7/00* | (2006.01) |

(52) U.S. Cl.

CPC ..... *B41J 11/0015* (2013.01); *B41J 2/32* (2013.01); *B41J 2/325* (2013.01); *B41J 13/12* (2013.01); *B41M 3/14* (2013.01); *B41M 5/38207* (2013.01); *B41M 5/38221* (2013.01); *B41M 5/38264* (2013.01); *B41M 7/0027* (2013.01)

(58) Field of Classification Search

CPC ... B41J 31/00; B41J 33/00; B41J 33/14; B41J 33/16; B41J 33/26; B41J 11/0015; B41J 2/32; B41M 3/14

See application file for complete search history.

(56) References Cited

U.S. PATENT DOCUMENTS

2012/0306986 A1 12/2012 Bouverie et al.

FOREIGN PATENT DOCUMENTS

| | | |
|---|---|---|
| JP | S61-61877 A | 3/1986 |
| JP | 2002-211064 A | 7/2002 |

OTHER PUBLICATIONS

Jul. 11, 2017 Search Report issued in French Patent Application No. 1661053.

*Primary Examiner* — Kristal Feggins

(74) *Attorney, Agent, or Firm* — Oliff PLC; R. Brian Drozd

(57) ABSTRACT

Method for protecting printed data on a varnish area of a transfer film of a heat-transfer machine, including: a varnishing step during which the varnish area and a plastic card advance simultaneously under the thermal head and during which the thermal head heats in order to deposit the varnish on the plastic card, generating a deformation of the transfer film at a text printed on the plastic card; a rewinding step during which the transfer film is rewound in order to position the varnish area upstream of the thermal head, and the plastic card is repositioned upstream of the thermal head; and a defacing step during which the varnish area and the plastic card advance simultaneously under the thermal head and during which the thermal head heats at the level of the text and at the deformation in accordance with a sign scheme making the deformation illegible.

5 Claims, 3 Drawing Sheets

METHOD FOR PROTECTING PRINTED DATA

BACKGROUND OF THE INVENTION

The present invention relates to a method for protecting printed data, as well as a machine implementing such a method.

A heat-transfer printer, and more particularly a heat-transfer plastic-card printer, comprises:

- a feed system that makes it possible to supply the printer with a blank plastic card, this feed system may be a card-by-card feed system or a reservoir of a plurality of cards provided with a card-separation system,
- an ejection system that makes it possible to eject each plastic card from the printer after printing, and
- between the feed system and the ejection system, a print module for printing on the plastic card.

The print module comprises:

- a feed roller on which a transfer film is wound, carrying an area of ink and an area of varnish to be deposited,
- a recovery roller on which the transfer film is wound after the ink and varnish have been applied to the plastic card,
- a print head between the feed roller and the recovery roller, and
- a backing roller disposed against the print head.

The transfer film is positioned between the plastic card and the print head.

When a plastic card is to be printed and varnished, the transfer film and the plastic card to be printed are synchronised with respect to the print head so that said plastic card and a blank area of the transfer film are presented simultaneously at the print head. The synchronisation takes place for example by means of position detectors which detect among other things the front edge of the plastic card when the plastic card advances towards the print head.

During printing, the print head heats the transfer film according to the characters to be printed, which causes the transfer of the ink from the transfer film onto the plastic card. As printing progresses, the plastic card and the transfer film advance simultaneously under the print head in order to print the plastic card, and the transfer film winds progressively on the recovery roller.

Following the printing of the characters on the card, the printer is designed to apply the varnish to the card in order to protect the printed elements from external attacks.

To deposit the varnish, the transfer film and the card are repositioned upstream of the print head and once again synchronised with respect to the print head, and then the heating of the print head and the simultaneous advance of the plastic card and transfer film cause the transfer of the varnish onto the plastic card.

Because of the presence of the ink on the plastic card, the characters printed on the plastic card are in relief and, on passage of the varnish area, these characters in relief deform the transfer film at the varnish area.

By recovering the transfer film wound on the recovery roller, it is then possible to find the data that were printed by observing the varnish area, which is unsatisfactory from the confidentiality point of view.

SUMMARY OF THE INVENTION

One object of the present invention is to propose a protection method that protects the data that are situated on the varnish area of a transfer film after printing.

To this end, a method is proposed for protecting the printed data on a varnish area of a transfer film of a heat-transfer machine comprising a thermal head, the machine being fed with a plastic card, the protection method comprising:

- a varnishing step during which the varnish area and the plastic card advance simultaneously under the thermal head and during which the thermal head heats in order to deposit the varnish on the plastic card, generating a deformation of the transfer film at a text printed on the plastic card,
- a rewinding step during which the transfer film is rewound in order to position the varnish area upstream of the thermal head, and the plastic card is repositioned upstream of the thermal head,
- a defacing step during which the varnish area and the plastic card advance simultaneously under the thermal head and during which the thermal head heats at the level of the text and at the deformation in accordance with a sign scheme making the deformation illegible.

Advantageously, the transfer film comprises an ink area and the protection method comprises, prior to the varnishing step:

- a printing step during which the processor simultaneously advances the ink area of the transfer film and the plastic card under the thermal head and during which the thermal head heats according to a text to be printed, and
- a return step during which the plastic card is returned upstream of the thermal head.

Advantageously, the protection method comprises a looping step during which the defacing step loops onto the rewinding step.

The invention also proposes a heat-transfer machine comprising:

- a feed system for feeding the machine with a plastic card,
- a feed roller on which a transfer film is wound, carrying at least one area of varnish to be deposited,
- a recovery roller on which the transfer film is wound after the varnish of the varnish area has been applied to a plastic card,
- a thermal head between the feed roller and the recovery roller,
- an ejection system for ejecting the plastic card from the machine after varnishing,
- a processor arranged to:
  - control the simultaneous advance of the varnish area of the transfer film and of the plastic card under the thermal head and the heating of the thermal head in order to deposit the varnish,
  - control the rewinding of the transfer film in order to position the varnish area upstream of the thermal head and the return of the plastic card upstream of the thermal head,
  - control the simultaneous advance of the varnish area and of the plastic card under the thermal head and the heating of the thermal head at the level of the text and at the deformation in accordance with a sign scheme for making the deformation illegible.

Advantageously, the transfer film comprises an ink area, and the processor is also arranged to:

- control the simultaneous advance of the ink area of the transfer film and of the plastic card under the thermal head and the heating of the thermal head in accordance with the text to be printed, control the return of the plastic card upstream of the thermal head.

BRIEF DESCRIPTION OF THE DRAWINGS

The features of the invention mentioned above, as well as others, will emerge more clearly from a reading of the following description of an example embodiment, said description being given in relation to the accompanying drawings, among which.

DETAILED DESCRIPTION OF THE PREFERRED EMBODIMENTS

Figure 1:
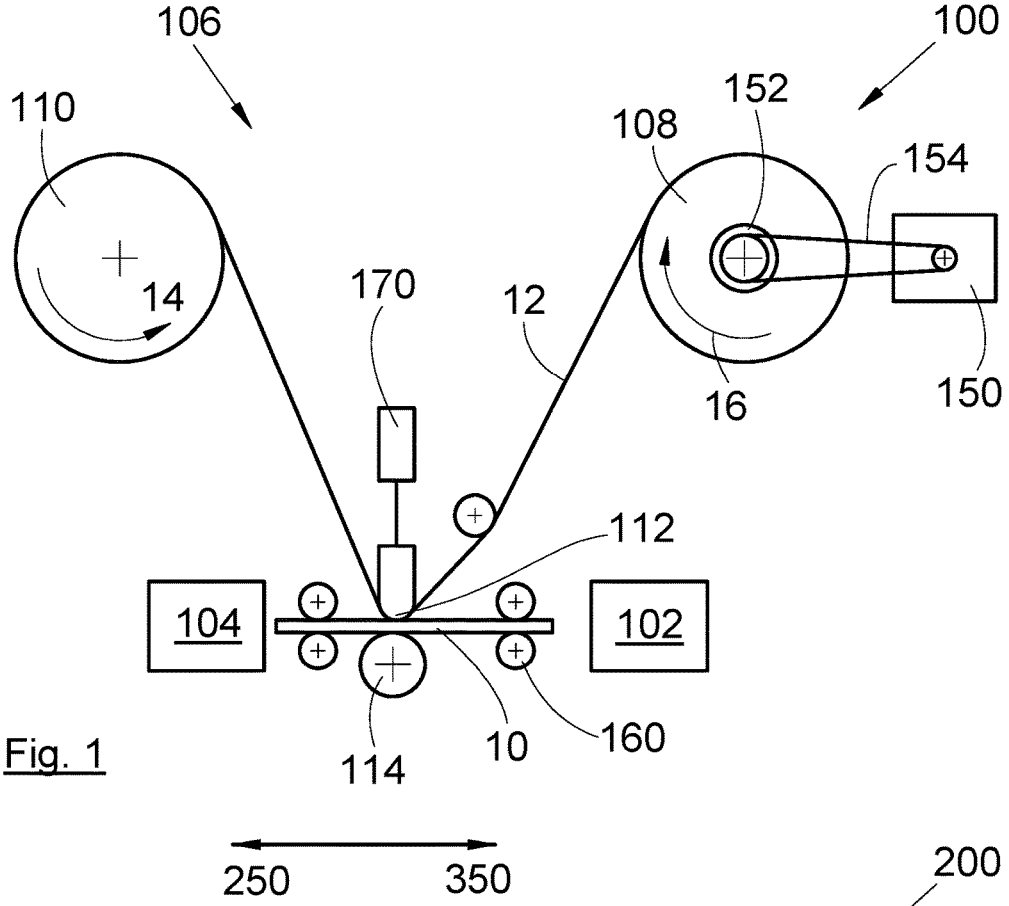
FIG. 1 is a schematic representation of a machine according to the invention.

FIG. 1 shows a machine 100 that is used in the context of the covering of a plastic card 10 with a varnish. The machine is of the heat transfer type. The machine 100 comprises:

- a feed system 102 that feeds the machine 100 with a plastic card 10, this feed system 102 may be a card-by-card feed system or a reservoir of a plurality of cards provided with a card-separation system,
- an ejection system 104 that ejects each plastic card 10 from the machine 100 after varnishing, and
- between the feed system 102 and the ejection system 104, a varnishing module 106 for varnishing the plastic card 10.

The feed system 102 and the ejection system 104 are not described any further since all types of known systems using motorised drive rollers may be used.

The varnishing module 106 comprises:

- a feed roller 108 on which a transfer film 12 carrying at least one area of varnish to be deposited is wound,
- a recovery roller 110 on which the transfer film 12 is wound after the varnish of the varnish area has been applied to the plastic card 10,
- a thermal head 112 between the feed roller 108 and the recovery roller 110, and
- a backing roller 114 disposed against the thermal head 112 in order to put the plastic card 10 under pressure against the thermal head 112.

The machine 100 also comprises movement means 160 for moving the plastic card 10 with respect to the thermal head 112, from upstream to downstream (the so-called printing direction 250) and vice versa (the reverse direction 350). The movement means 160 here take the form of rollers that are in abutment against the top face and the bottom face of the plastic card 10 and which comprise a motor designed to drive the rollers in one direction or the other. Thus, according to the direction of rotation of the rollers, the plastic card 10 moves from the feed system 102 towards the ejection system 104 (the printing direction 250) or vice versa (the reverse direction 350). These or some of these rollers may form part of the feed system 102 and of the ejection system 104 according to their positions with respect to the thermal head 112.

The transfer film 12 is positioned between the plastic card 10 and the thermal head 112, and is in the form of a band comprising at least one varnish area.

Depending on what must be deposited on the plastic card 10, the thermal head 112 is controlled so as to heat certain points/areas of the transfer film 12.

The various outward/return movements of the plastic card 10 as described below are performed by the movement means 160.

In order to carry out the varnishing, the plastic card 10 is positioned upstream of the thermal head 112. The plastic card 10 is then synchronised with the varnish area, and then the plastic card 10 and the transfer film are driven in the printing direction 250 to enable varnish to be deposited on the plastic card 10 by heating of the thermal head 112. Following the deposition of the varnish, the transfer film 12 is deformed at the characters that are printed on the plastic card 10.

After varnishing, the plastic card 10 is subjected to a return (the reverse direction 350) that repositions it upstream of the thermal head 112. The plastic card 10 is then synchronised with the area of varnish already used, and then the plastic card 10 and the transfer film are driven in the printing direction 250 to allow heating of the varnish area by heating of the thermal head 112. Following this heating, the plastic card 10 is taken up by the ejection system 104, which ejects the plastic card from the machine 100.

As stated, the plastic card 10 and the varnish area already used are synchronized and the defacing of the varnish area is then realized with the same plastic card 10 and in front of the same area of the same plastic card 10, it means the area of the plastic card 10 which carries the printed text. It is not necessary to use a supplementary disposable plastic card.

The driving of the transfer film 12 during the varnishing is effected by a motor with which the recovery roller 110 is equipped and which drives said recovery roller 110 in a direction 14 of winding of the transfer film 10 on the recovery roller 110.

In the context of the invention, the machine 100 also comprises a rewinding motor 150 that is designed to drive the feed roller 108 in a direction 16 of winding of the transfer film 10 on the feed roller 108. The transfer film 12 is then driven in the opposite direction to the printing direction 250. The rewinding motor 150 here acts by means of a belt 154 installed between the shaft of the rewinding motor 150 and the shaft of the feed roller 108.

The machine 100 also comprises an angular encoder 152 mounted on the feed roller 108 and which counts the number of degrees that the feed roller 108 turns through during varnishing. This angular encoder 152 may take various forms such as for example a set of fixed teeth or holes on the feed roller 108 and disposed on the periphery of a circle coaxial with the rotation axis of the feed roller 108, and an optical sensor that counts the number of teeth or holes passing in front of it during the varnishing. This angular encoder 152 may also be a magnetic encoder. The angular encoder 15 conventionally delivers information relating to the number of pulses generated during rotation, the pulses are generated by magnetic or optical elements as described above. The information delivered by the angular encoder 152 makes it possible, among other things, to determine the number of turns that the feed roller 108 must make in order to place the varnish area once again upstream of the thermal head 112.

Figure 2:
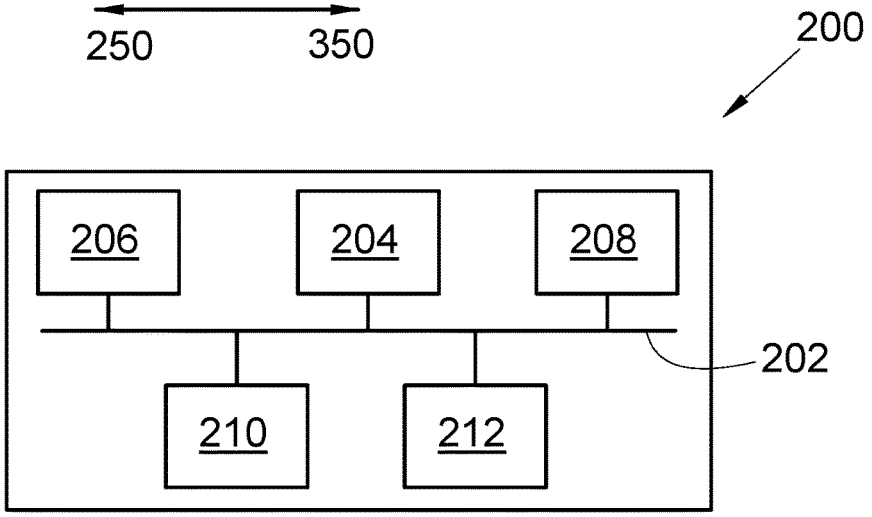
FIG. 2 shows an architecture of a control unit of the machine according to the invention.

FIG. 2 shows a control unit 200 of the machine 100. The control unit 200 comprises, connected by a communication bus 202: a processor 204 or CPU (central processing unit), a random access memory RAM 206, a read only memory ROM 208, at least one communication interface 210 of the input/output type, enabling the control unit 200 to communicate with the various motors, the thermal head 112 and the various sensors of the machine 100, and optionally a storage unit 212 such as a hard disk or a storage medium reader, such as an SD (secure digital) card reader.

The processor 204 is capable of executing instructions loaded into the RAM 206 from the ROM 208, from an external memory (not shown), from a storage medium (such as an SD card), or from a communication network. When the machine 100 is powered up, the processor 204 is capable of reading instructions from the RAM 206 and executing them. These instructions form a computer program causing the implementation, by the processor 204, of all or some of the algorithms and steps described below.

All or some of the algorithms and steps described below may be implemented in software form by the execution of a set of instructions by a programmable machine, for example a DSP (digital signal processor) or a microcontroller, or be implemented in hardware form by a machine or a dedicated component, for example an FPGA (field-programmable gate array) or an ASIC (application-specific integrated circuit).

Figure 3A:
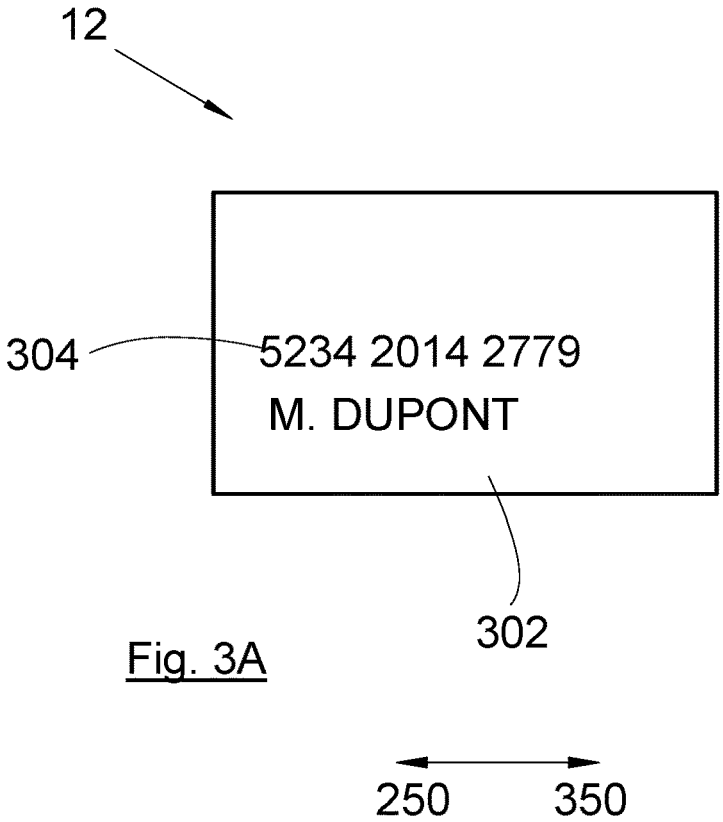
FIG. 3A is a representation of the transfer film as it appears after the application of the varnish.

FIG. 3A shows the varnish area 302 of a transfer film 12 as it appears after the varnish has been deposited. The text that is printed on the plastic card 10 appears in clear and in the form of a character 304 in relief in the varnish area 302.

After the plastic card 10 has been varnished, the transfer film 12 is rewound in the opposite direction 350 on the feed roller 108 by the rewinding motor 150 so as to place the varnish area 302 once again upstream of the thermal head 112, and the plastic card 10 is subjected to a return (the reverse direction 350) that repositions it upstream of the thermal head 112.

The transfer film 12 and more particularly the varnish area 302 and the plastic card 10 are synchronised with the thermal head 112, and then the transfer film 12 and the plastic card 10 are driven in the printing direction 250, passing under the thermal head 112, which heats the transfer film 12 at the characters 304 in relief.

The processor 204 knows the position of the text that is printed on the plastic card 10 and therefore, because of the various synchronisations 152, knows the position of the characters 304 in relief on the varnish area 302.

Figure 3B:
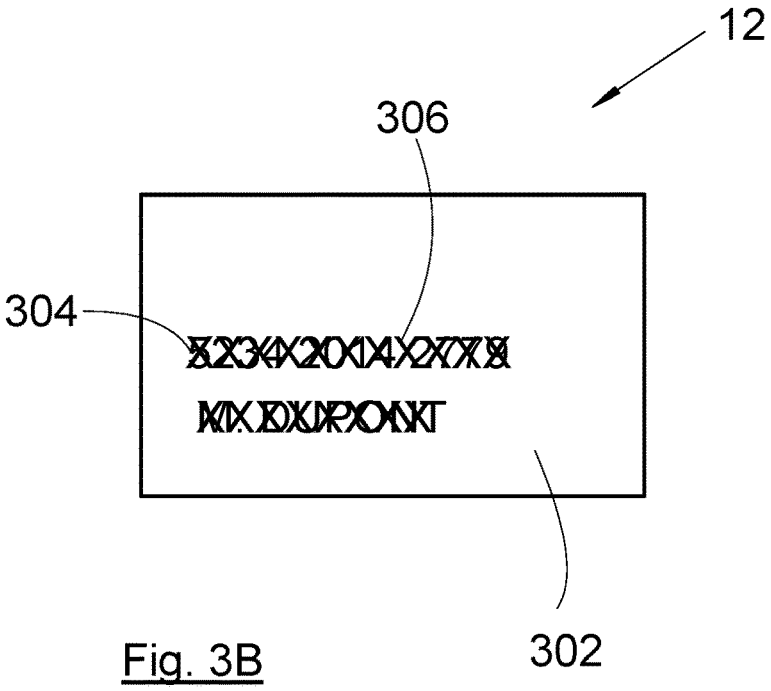
FIG. 3B is a representation of the transfer film as it appears after application of the data protection method according to the invention.

FIG. 3B shows the varnish area 302 after implementation of the defacing.

When the varnish area 302, after it has served to varnish the plastic card 10, passes under the thermal head 112, the processor 204 controls the heating of the thermal head 112 at the level of the text on the plastic card 10 and at the characters 304 in relief in accordance with the signs 306 in order to simulate a printing that deforms the characters 304 in relief and to make them illegible.

In the embodiment of the invention presented here, the signs 306 are a series of Xs that mask the characters 304 in relief. Naturally other signs can be envisaged, such as Chinese or Japanese ideograms, successions of broken lines, etc.

Preferentially, in order to facilitate the rewinding of the transfer film 12 and the return of the plastic card 10, the thermal head 112 is raised and therefore moved away from the plastic card 10 before rewinding and is lowered at the end of the rewinding. To do this, the machine 100 has an elevator 170 to which the thermal head 112 is fixed and which is arranged so as to raise and lower the thermal head 112. The elevator 170 controlled by the processor 204 can take various forms, such as for example a motor with a cam, an electromagnet, etc.

To prevent the rotation of the feed roller 108 during printing generating forces on the rewinding motor 150, it is preferable to position a clutch between the rewinding motor 150 and the feed roller 108. This clutch is arranged so as to transmit a force from the rewinding motor 150 to the feed roller 108 and to prevent the transmission of forces from the feed roller 108 to the rewinding motor 150. This clutch may be electrical and controlled by the processor 204 or be mechanical of the clutch spring type.

Figure 4:
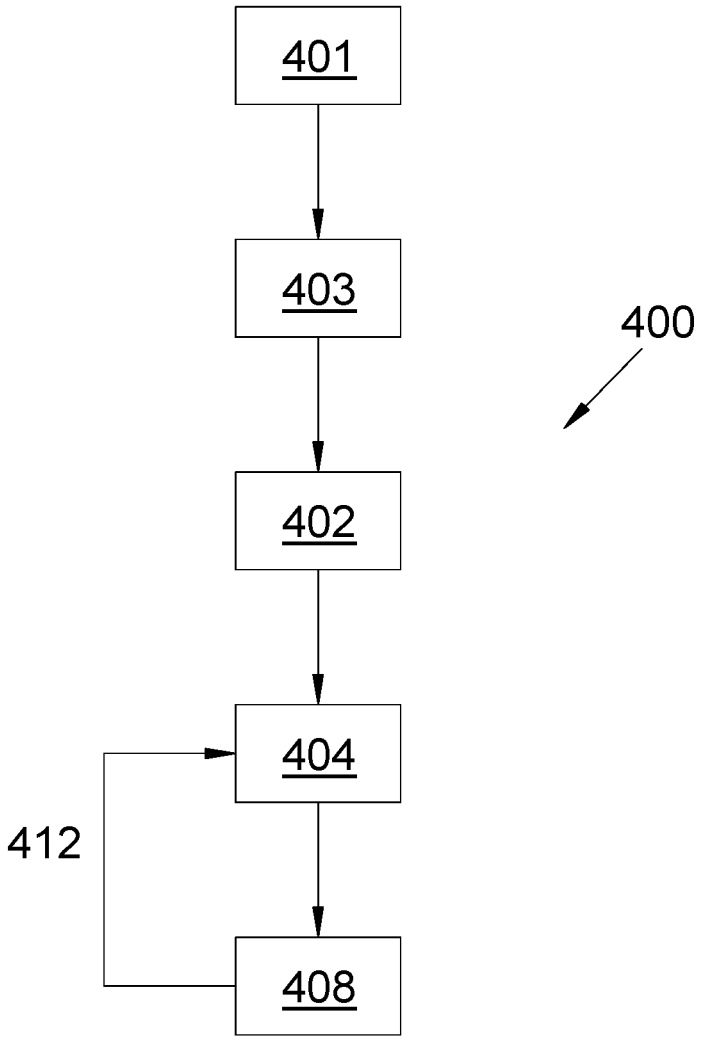
FIG. 4 shows an algorithm of a protection method according to the invention.

FIG. 4 shows an algorithm of a method 400 for protecting data printed on a varnish area 302 of the transfer film 12 of the machine 100 fed with a printed plastic card 10, the protection method 400 comprises:

- a varnishing step 402 during which the processor 204 controls the simultaneous advance of the varnish area 302 of the transfer film 12 and of the plastic card 10 under the thermal head 112 and the heating of the thermal head 112 in order to deposit the varnish on the plastic card 112, causing a deformation 304 of the transfer film 12 at the printed text,
- a rewinding step 404 during which the processor 204 controls the rewinding of the transfer film 12 in order to position the varnish area 302 upstream of the thermal head 112 and the return of the plastic card 10 upstream of the thermal head 112, and
- a defacing step 408 during which the processor 204 controls the simultaneous advance of the varnish area 302 of the transfer film 12 and of the plastic card 10 under the thermal head 112 and the heating of the thermal head 112 at the level of the text and at the deformation 304 in accordance with a diagram of signs 306 making the deformation 304 illegible.

The advance of the plastic card 10 during the defacing step 408 and its return during the rewinding step 404 are performed by the motor of the movement means 106, which is controlled by the processor 204.

The advance of the transfer film 12 during the varnishing step 402 and the defacing step is performed by the motor associated with the recovery roller 110, which is controlled by the processor 204. During these steps, the angle counter 152 makes it possible to know the number of turns that the feed roller 108 has made.

The rewinding of the transfer film 12 is carried out by the rewinding motor 150, which is controlled by the processor 204. The rewinding length of the transfer film 12 is determined from information from the angle counter 152 during the previous advance of the transfer film 12.

Such a method makes it possible to deform the characters 304 in relief on the varnish area 302 and therefore to make them illegible.

Following the defacing step 408, the plastic card 10 is subjected to an ejection step during which the processor 204 controls the advance of the plastic card 10 as far as the ejection system 104, where the plastic card 10 is expelled from the machine 100.

In the context of the protection method 400 described above, the processor 204 is arranged so as to:

- control the simultaneous advance of the varnish area 302 of the transfer film 12 and of the plastic card 10 under the thermal head 112 and the heating of the thermal head 112 in order to deposit the varnish, control the rewinding of the transfer film 12 in order to position the varnish area 302 upstream of the thermal head 112 and the return of the plastic card 10 upstream of the thermal head 112, control the simultaneous advance of the varnish area 302 and of the plastic card 10 under the thermal head 112 and the heating of the thermal head 112 at the level of the text and at the deformation 304 in accordance with a sign scheme 306 for making the deformation 304 illegible.

Naturally it is possible to effect a plurality of defacings of the same type on the same varnish area 302 with different signs in order to further improve the defacing.

The protection method 400 then comprises, following the defacing step 408, a looping 412 onto the rewinding step 404 in order to perform a new interference step 408. The number of loops 412 can be parameterised in the processor 204, for example according to a degree of confidentiality to be achieved. The card-ejection step then takes place following these various defacing steps.

As stated above, between each defacing step and each rewinding step, the protection method 400 may comprise a raising step during which the processor 204 controls the raising of the thermal head 112 and, between each rewinding step and each defacing step, the protection method 400 then comprises a lowering step during which the processor 204 controls the lowering of the thermal head 112.

The invention has been described particularly in the context of an independent varnishing machine 100 but applies in the same way if the machine 100 is incorporated in a plastic-card printer. The machine 100 is then a varnishing module of the printer that moreover comprises a print module that is arranged upstream of the varnishing module with respect to the plastic-card transfer path. The print module is then fed with blank plastic cards 10 and prints them and then ejects them towards the feed system 102 of the varnishing module 100, which then covers the plastic card 10 thus printed with varnish and defaces the transfer film 12 as described.

Although the invention has been particularly presented in the case where the transfer film 112 has only varnish, it applies in the same way if the transfer film 112 also has ink areas for printing a plastic card 10. The machine 100 then constitutes a printer and a varnishing machine. The feed system 102 then feeds the machine 100 with blank cards and the ejection system 104 ejects each card after it has been printed and varnished.

The varnishing module 106 is then a module that also allows printing of the plastic card 10.

There may thus for example be a monochrome ink area followed by a varnish area, and so on, or an ink area comprising three blocks of three different colours followed by a varnish area and so on.

The general operating principle of the machine 100 is then identical to the operating principle of a printer of the prior art. A plastic card 10 is captured by the feed system 102 and driven to the thermal head 112, which heats the transfer film 12 at the ink areas according to the data to be printed in order to transfer the ink onto the plastic card 10.

In the case of monochrome printing, the plastic card 10 is synchronised with respect to the thermal head 112, with an ink area of the transfer film 12 that is blank, that is to say that has not yet passed under the thermal head 112, and then the plastic card 10 and the transfer film 12 make a simple outward journey (the printing direction 250) under the thermal head 112 in order to deposit the ink.

In the case of multicolour printing, the printings of the various colours take place successively following outward trips (the printing direction 250) and return trips (the reverse direction 350) of the plastic card 10 under the thermal head 112. The plastic card 10 is repositioned upstream of the thermal head 112 and synchronised with the block carrying the following colour before passing under the thermal head 112 again with the transfer film 12.

After having been printed, the plastic card 10 is subjected to another return (the reverse direction 350), which positions it upstream of the thermal head 112. The plastic card 10 is then synchronised with the varnish area, and then the plastic card 10 and the transfer film are driven in the printing direction 250 to allow the deposition of varnish on the plastic card 10 by heating of the thermal head 112. Following the deposition of the varnish, the transfer film 12 is deformed at the characters that are printed on the plastic card 10, as described above.

In this context, the protection method comprises, prior to the varnishing step 402:

a printing step 401 during which the processor 204 controls the simultaneous advance of the ink area of the transfer film 12 and of the plastic card 10 under the thermal head 112 and the heating of the thermal head 112 in accordance with a text to be printed in order to transfer the ink to the plastic card 10, a return step 403 during which the processor 204 controls the return of the plastic card 10 upstream of the thermal head 112.

The printing step 401 may comprise a plurality of printing and rearward-return sub-steps in the case of multicolour printing.

The advance of the transfer film 12 during the printing step 401 is also performed by the motor associated with the recovery roller 110, which is controlled by the processor 204. In the same way, the simultaneous advance of the plastic card 10 during the printing step 401 is carried out by the motor of the movement means 160, which is controlled by the processor 204. During these steps, the angle counter 152 makes it possible to know the number of turns that the feed roller 108 has made.

The return of the plastic card 10 during the return 403 is carried out by the motor of the movement means 160, which is controlled by the processor 204.

The processor 204 is arranged to:

control the simultaneous advance of the ink area of the transfer film 12 and of the plastic card 10 under the thermal head 112 and the heating of the thermal head 112 according to the text to be printed, control the return 403 of the plastic card 10 upstream of the thermal head 112.

Before the printing step 401, the protection method 400 conventionally comprises a feed step during which the processor 204 controls the feed system 102 in order to supply the print module 106 with a plastic card 10 to be printed.

The invention claimed is:

1. A method for protecting printed data on a varnish area of a transfer film of a heat-transfer machine comprising a thermal head, wherein the transfer film comprises an ink area, the machine being fed with a plastic card, the protection method comprising:

a printing step during which the ink area of the transfer film and the plastic card are simultaneously advanced under the thermal head and during which the thermal head heats according to a text to be printed, a return step during which the plastic card is returned upstream of the thermal head;

a varnishing step during which the varnish area and the plastic card advance simultaneously under the thermal head and during which the thermal head heats in order to deposit the varnish on the plastic card, generating a deformation of the transfer film at a text printed on the plastic card, a rewinding step during which the transfer film is rewound in order to position the varnish area upstream of the thermal head, and the plastic card is repositioned upstream of the thermal head, a defacing step during which the varnish area and the plastic card advance simultaneously under the thermal head and during which the thermal head heats at the level of the text and at the deformation in accordance with a sign scheme making the deformation illegible.

2. The protection method according to claim 1, further comprising a looping step during which the defacing step loops back onto the rewinding step.

3. A heat-transfer machine comprising:

a feed system for feeding the machine with a plastic card, a feed roller on which a transfer film is wound, carrying at least one area of varnish to be deposited, a recovery roller on which the transfer film is wound after the varnish of the varnish area has been applied to a plastic card, a thermal head between the feed roller and the recovery roller, an ejection system for ejecting the plastic card from the machine after varnishing, a processor arranged to:

control the simultaneous advance of the varnish area of the transfer film and of the plastic card under the thermal head and the heating of the thermal head in order to deposit the varnish, control the rewinding of the transfer film in order to position the varnish area upstream of the thermal head and the return of the plastic card upstream of the thermal head, control the simultaneous advance of the varnish area and of the plastic card under the thermal head and the heating of the thermal head at the level of the text and at the deformation in accordance with a sign scheme for making the deformation illegible.

4. The heat-transfer machine according to claim 3, wherein the transfer film comprises an ink area, and in that the processor is also arranged to:

control the simultaneous advance of the ink area of the transfer film and of the plastic card under the thermal head and the heating of the thermal head in accordance with the text to be printed, control the return of the plastic card upstream of the thermal head.

5. A method for protecting printed data on a varnish area of a transfer film of a heat-transfer machine comprising a thermal head, the machine being fed with a plastic card, the protection method comprising:

a varnishing step during which the varnish area and the plastic card advance simultaneously under the thermal head and during which the thermal head heats in order to deposit the varnish on the plastic card, generating a deformation of the transfer film at a text printed on the plastic card;

a rewinding step during which the transfer film is rewound in order to position the varnish area upstream of the thermal head, and the plastic card is repositioned upstream of the thermal head a defacing step during which the varnish area and the plastic card advance simultaneously under the thermal head and during which the thermal head heats at the level of the text and at the deformation in accordance with a sign scheme making the deformation illegible; and a looping step during which the defacing step loops back onto the rewinding step.

* * * * *